US006021292A

United States Patent [19]

Nakajima et al.

[11] Patent Number: 6,021,292

[45] Date of Patent: Feb. 1, 2000

[54] TONER CARTRIDGE AND TONER COLLECTING MECHANISM

[75] Inventors: Shigeki Nakajima; Takashi Wakana, both of Tokyo, Japan

[73] Assignee: Oki Data Corporation, Tokyo, Japan

[21] Appl. No.: 09/265,407

[22] Filed: Mar. 10, 1999

[30] Foreign Application Priority Data

Mar. 13, 1998 [JP] Japan ..... 10-063070

[51] Int. Cl.[7] ..... G03G 15/08

[52] U.S. Cl. ..... 399/120; 222/DIG. 1

[58] Field of Search ..... 399/120, 119, 399/107, 108, 111, 262, 263, 360; 222/DIG. 1

[56] References Cited

U.S. PATENT DOCUMENTS

| | | | |
|---|---|---|---|
| 4,963,940 | 10/1990 | Nemoto et al. | 399/262 |
| 5,381,217 | 1/1995 | Ishida | 399/120 |
| 5,737,668 | 4/1998 | Johroku | 399/120 |
| 5,848,342 | 12/1998 | Tanda | 399/120 X |

FOREIGN PATENT DOCUMENTS

| | | |
|---|---|---|
| 62-215990 | 9/1987 | Japan . |
| 3-153271 | 7/1991 | Japan . |
| 6-242674 | 9/1994 | Japan . |

*Primary Examiner*—Matthew S. Smith
*Assistant Examiner*—Hoan Tran
*Attorney, Agent, or Firm*—Rabin & Champagne, PC

[57] ABSTRACT

A toner cartridge includes a hollow outer body, hollow inner body, and partition. The inner body is inserted into an outer body and slidably rotatable relative to the outer body. A partition is supported in the outer body and is slidable relative to the outer body in a longitudinal direction of the cartridge. The partition is at a first position substantially adjacent a longitudinal end when the inner body is at a closing position. The partition is moved to a second position after the inner body has been rotated to the opening position, thereby defining a residual toner accommodating space between the partition and the longitudinal end of the outer body. An agitating member may be provided in which a residual toner accommodating space is formed therein. The residual toner removed from a photoconductive drum is collected in a first toner receiving section. The residual toner is then carried by a screw conveyor to one side of the print process cartridge. A second toner receiving section is coupled to the toner cartridge, remote from the first toner receiving section. A belt carries the residual toner from the first toner receiving section at one side of the print process cartridge to the second toner receiving section.

13 Claims, 18 Drawing Sheets

TONER CARTRIDGE AND TONER COLLECTING MECHANISM

FIELD OF THE INVENTION

The present invention relates to a toner cartridge and a toner collecting mechanism.

DESCRIPTION OF THE RELATED ART

A print process cartridge used in a conventional electrophotographic recording apparatus includes a charging unit, a photoconductive drum, and a developing unit, which are all built in the print process cartridge. A toner cartridge is detachably loaded to the print process cartridge and supplies toner to the developing unit.

A charging unit uniformly charges a surface of the photoconductive drum and an exposing unit illuminates the charged surface to form an electrostatic latent image thereon. The rotating photoconductive drum carries the electrostatic latent image to the developing unit where the electrostatic latent image is developed with toner into a toner image. The toner image is then carried to a transfer unit where the toner image is transferred to print paper. The print paper is then transported to a fixing unit where the toner image is fused and fixed on the print paper.

Some amount of toner is left on the surface of the photoconductive drum after the transfer operation. The residual toner is removed from the surface by a cleaning means and collected into a residual toner tank disposed within the print process cartridge.

Therefore, a space is required for accommodating the residual toner tank, leading to a large overall size of the electrophotographic recording apparatus.

It has been proposed that collected toner is delivered into the toner cartridge and is discarded together with the toner cartridge at an appropriate later time.

However, since the overall size of the toner cartridge is limited, if the toner cartridge is to have a space for residual toner, the space for fresh toner has to be small. Thus, the toner cartridge must be replaced more frequently. The frequent replacement of toner cartridge increases print cost per page.

The space for accommodating the fresh toner can be increased only at the expense of increasing the overall size of toner cartridge.

SUMMARY OF THE INVENTION

The present invention was made to solve the aforementioned drawbacks of the conventional art.

An object of the present invention is to provide a toner cartridge and a toner collecting device wherein a sufficient amount of fresh toner can be supplied and the overall size of the recording apparatus is reduced.

A toner cartridge comprises a hollow outer body, hollow inner body, and partition. The outer body extends in a longitudinal direction thereof and has a longitudinal end and at least one first opening formed therein. The inner body is inserted into the outer body and slidably rotatable relative to the outer body. The inner body holds toner therein. The inner body has at least one second opening formed therein. The second opening is aligned with the first opening when the inner body is slid relative to the outer body, thereby allowing the toner to be discharged out of the inner body. A partition is disposed in the outer body and is slidable relative to the outer body in the longitudinal direction from a first position to a second position when said inner body is slid relative to said outer body, thereby defining a residual toner accommodating space between the partition and the first longitudinal end of the outer body.

The toner cartridge may include an agitating member in place of the partition. The agitating member is supported in the inner body and is rotatable relative to the inner body and the outer body substantially about a longitudinal axis of the inner body. The agitating member has a residual toner accommodating space formed therein.

A toner collecting apparatus is provided in an electrophotographic recording apparatus. The toner cartridge having a residual toner chamber is detachably loaded into a print process cartridge, which in turn is assembled into the electrophotographic recording apparatus. A first toner receiving section extends along a photoconductive body supported in the print process cartridge, and receives residual toner removed from the surface of the photoconductive body. A first toner carrying member such as a screw conveyor accommodated in the toner receiving section carries the residual toner to one side of the print process cartridge. A second toner receiving section is located adjacent the toner cartridge, remote from the first toner receiving section. A second toner carrying member such as a belt is provided between one side of the print process cartridge and the second toner receiving section. The toner carrying member carries the residual toner from the one side of the print process cartridge to the second toner receiving section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Preferred embodiments of the present invention will be described in detail with reference to the accompanying drawings.

First Embodiment

<Overall Construction>

Figure 1:
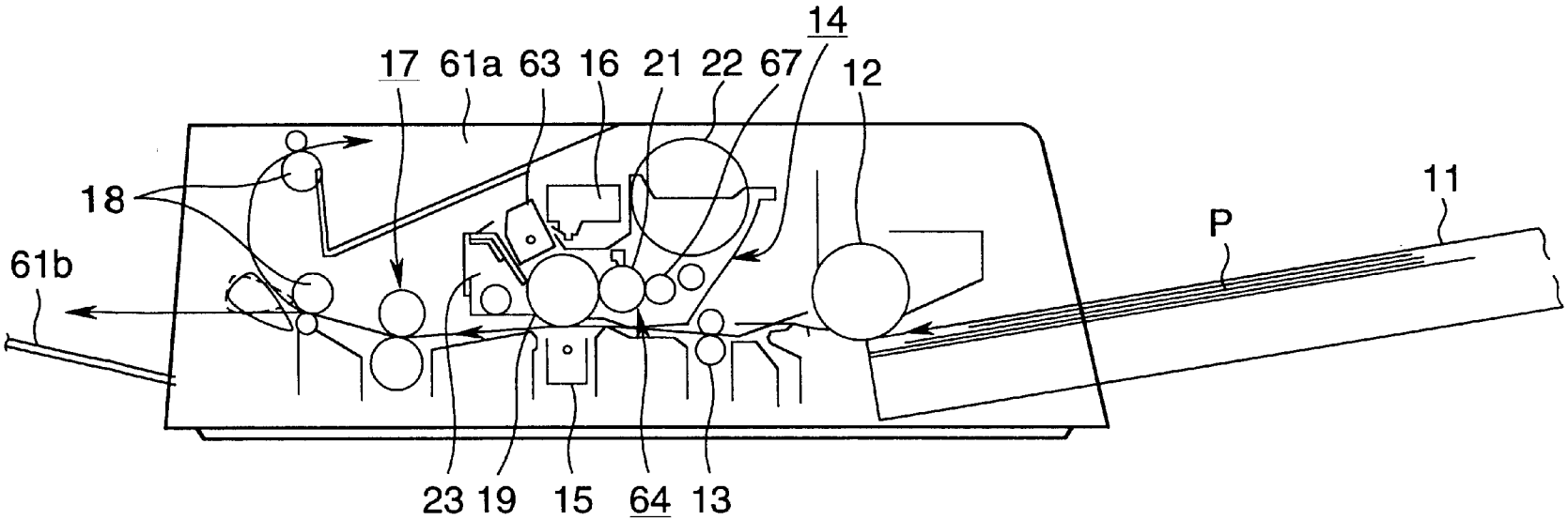
FIG. 1 is a cross-sectional view illustrating an electrophotographic recording apparatus according to the first embodiment.

FIG. 1 is a cross-sectional view illustrating an electrophotographic recording apparatus according to the first embodiment. A paper cassette 11 accommodates a stack of print paper P therein. Each page of the print paper P is fed by a feed roller 12 from the paper cassette 11 to transport rollers 13, which in turn feed the print paper P into a print process cartridge 14. A photoconductive drum 19 is rotated by a drum motor, not shown. A charging unit 63 uniformly charges the surface of the photoconductive drum 19 as the photoconductive drum 19 rotates. An exposing unit 16 starts illuminating the charged surface of the photoconductive drum 19 in timed relation to the travel of the print paper P, thereby forming an electrostatic latent image on the photoconductive drum 19. The latent image is then carried to a developing unit 64 where the latent image is developed with toner supplied from a toner cartridge 22. Residual toner on the photoconductive drums 19 after transfer is collected by a cleaning unit 23. The developing unit 64 includes a developing roller 21 that rotates in contact with the photoconductive drum 19, and the toner supplying roller 67 that supplies fresh toner to the developing roller 21.

A transfer unit 15 is disposed to oppose the photoconductive drum 19 and transfers the toner image from the photoconductive drum 19 to the print paper P. A fixing unit 17 fixes the toner image on the print paper P and the discharge rollers 18 discharge the print paper to the paper stacker 61*a* or 61*b*.

The residual toner on the photoconductive drum 19 is removed from the photoconductive drum 19 and returned to the toner cartridge 22.

<Print Process Cartridge>

The print process cartridge 14 will be described in detail.

Figure 2:
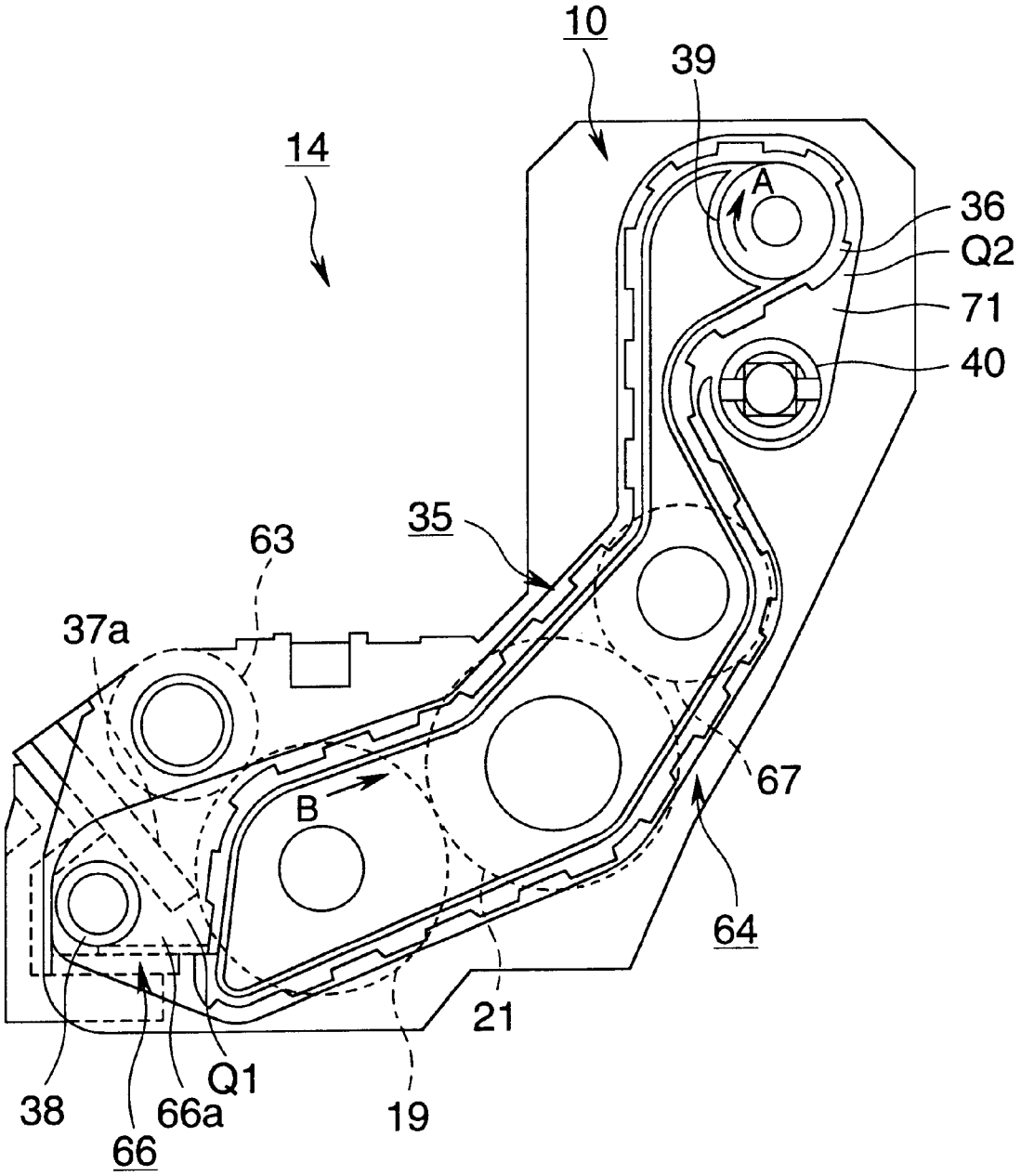
FIG. 2 is a side view of the print process cartridge according to a first embodiment.
Figure 3:
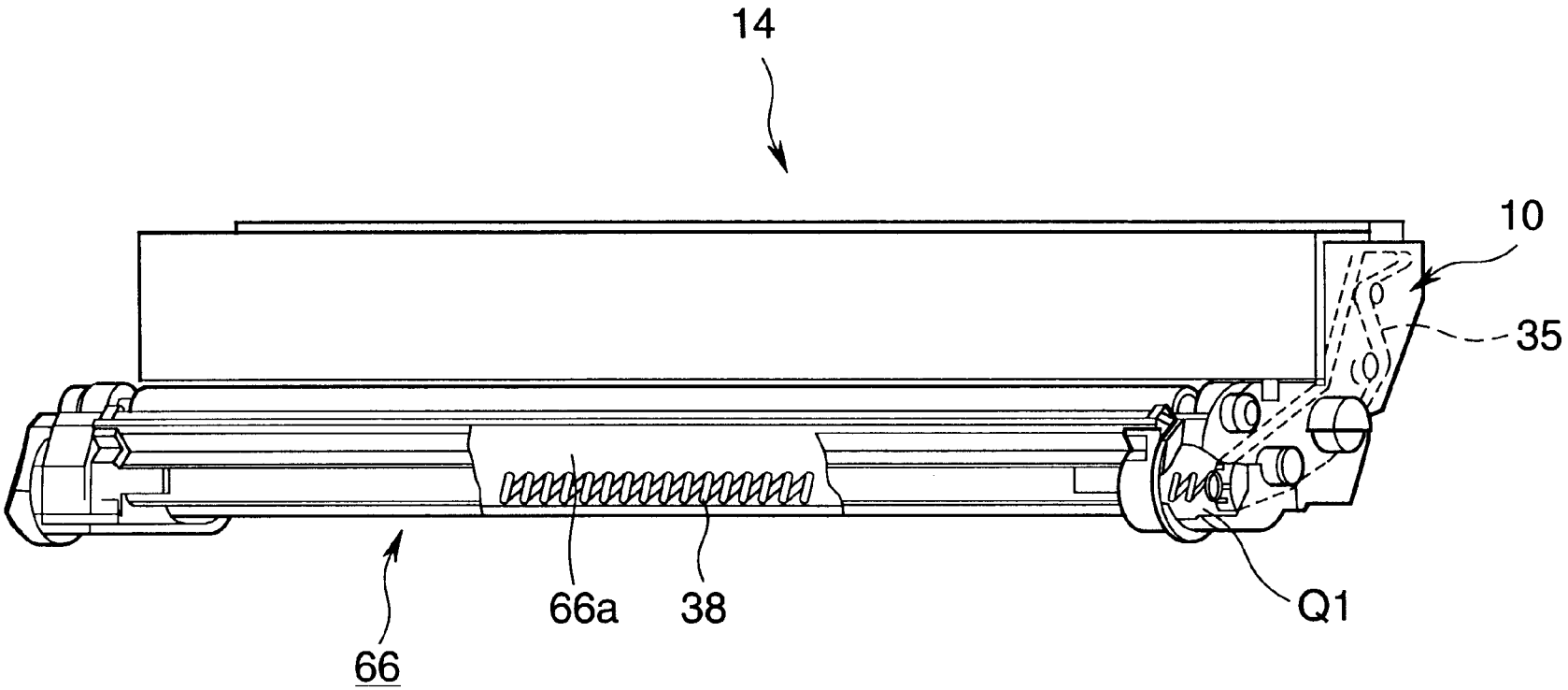
FIG. 3 is a perspective view of the print process cartridge of the first embodiment.

FIG. 2 is a side view of the print process cartridge 14 according to the first embodiment. FIG. 3 is a perspective view of the print process cartridge 14.

Referring to FIG. 2, the print process cartridge 14 includes a photoconductive drum 19, charging unit 63, developing unit 64, and toner collecting mechanism that collects the residual toner removed from the photoconductive drum 19.

The toner collecting mechanism includes a cleaning unit 66, and a loop-like groove 35, and a residual toner tank 71. The cleaning unit 66 includes a blade 37*a*, a toner accommodating space 66*a*, and a screw conveyor 38. The blade 37*a* scrapes the residual toner adhering to the surface of the photoconductive drum 19. The toner accommodating space 66*a* extends in a direction parallel to the rotational axis of the photoconductive drum 19 and receives the residual toner scraped off the photoconductive drum 19. A screw conveyor 38 transports the residual toner to one side of the print process cartridge 14 (FIG. 3).

The loop-like groove 35 is formed in a side frame 10 of the print process cartridge 14 and runs around the shafts, not shown, of the photoconductive drum 19, developing roller 21, toner supply roller 67. The groove 35 runs such that the groove 35 does not interfere with the rotation of the rotating components. The groove 35 receives a toner transporting belt 36 therein, which runs along the groove 35 in a direction shown by an arrow B when a pulley 39 is rotated in a direction shown by arrow A by a drive source, not shown.

The groove 35 communicates with a toner accommodating space 66*a* through a toner outlet Q1 which is located at a lower end of the print process cartridge 14. The transport belt 36 is provided with a plurality of projections and recesses for the toner transporting purpose. The transport belt 36 receives the residual toner at the toner outlet Q1 and delivers the residual toner in the direction shown by arrow B.

The residual toner tank 71 communicates with the groove 35 through a toner inlet Q2 which is located at an upper end of the print process cartridge 14. The toner transport belt 36 is exposed to the inside of the residual toner tank 71 and cascades the collected toner onto the screw conveyor 40 disposed in the residual toner tank 71. The screw conveyor 40 delivers the collected toner to the toner cartridge 22 (FIG. 1)

<Operation of Toner Collecting Mechanism>

The operation of the toner collecting mechanism of the aforementioned construction will be described.

The toner left on the surface of the photoconductive drum 19 after the transfer operation of a toner image, is scraped off the surface by the blade 37*a* and collected into the toner accommodating space 66*a*. Then, the collected toner is delivered by the screw conveyor 38 to the toner outlet Q1 at one side of the print process cartridge 14 and then the collected toner in the toner outlet Q1 is transported by the toner transporting belt 36.

The collected toner on the toner transporting belt 36 is transported to the toner inlet Q2 as the toner transporting belt 36 runs. The collected toner on the transporting belt 36 is cascaded into the residual toner tank 71. The residual toner is then delivered by the screw conveyor 40 (FIG. 16), which will be described later, to the toner cartridge 22.

It is to be noted that the groove 35 is formed in an inner side of the frame 10 and located at an inner side from the longitudinal ends of the shafts of the photosensitive drum 19, developing roller 21, toner supplying roller 67, etc. Thus, the screw conveyors 38 and 40 and associated mechanical components need not be disposed outside of the frame 10. Therefore, the construction allows the overall width of the apparatus to remain substantially the same and lends itself to miniaturizing the electrophotographic recording apparatus.

The groove 35 guides the transporting belt 36 when the belt 36 runs. There is no need for a gear train such as worm gears that transmit a drive force to the transporting belt 36. This construction reduces the rotational load on a drum motor, not shown, preventing degradation of print quality due to the unstable drum speed resulting from a heavy load on the drum motor. Moreover, the number of parts can be reduced so that the manufacturing cost of the electrophotographic recording apparatus decreases and the assembly efficiency is improved.

<Toner Cartridge>

The toner cartridge 22 will now be described.

Figure 4:
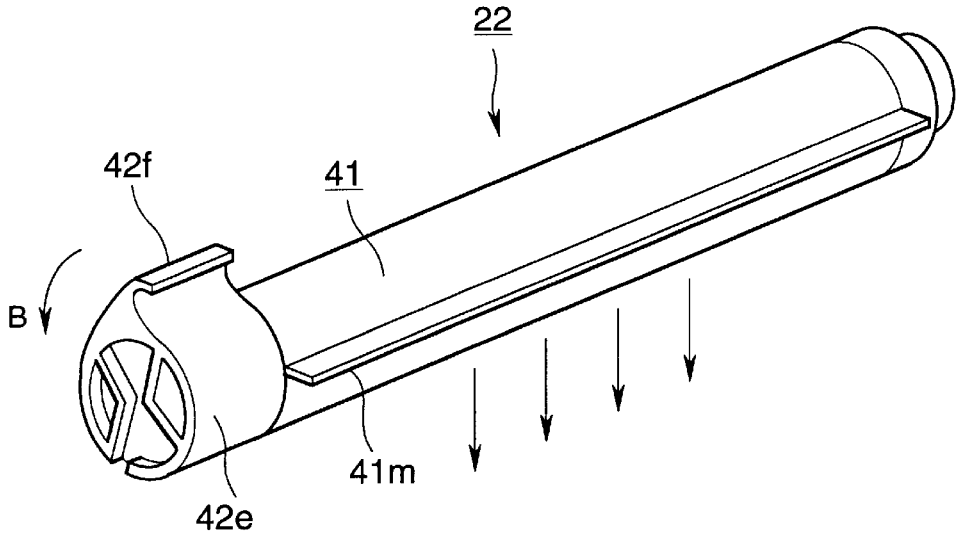
FIG. 4 is a perspective view of the toner cartridge of the first embodiment.
Figure 5:
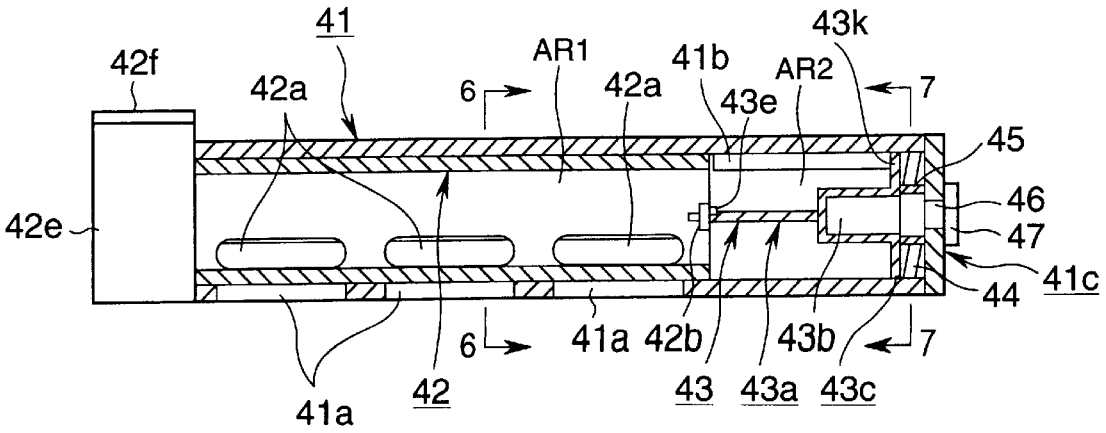
FIG. 5 is a cross-sectional view of a toner cartridge according to the first embodiment.

FIG. 4 is a perspective view of the toner cartridge 22 with a knob 42*e* at a closing position where the toner in the toner cartridge is not discharged. When a lever 42*f* is operated in a direction shown by arrow B, the knob 42*e* is rotated toward an opening position where the toner in the toner cartridge is discharged in direction shown by arrows through toner exiting openings (FIG. 5). When the toner cartridge is not loaded into the print process cartridge, the knob 42*e* is at the closing position.

FIG. 5 is a longitudinal cross-sectional view of a toner cartridge according to the first embodiment.

Figure 6:
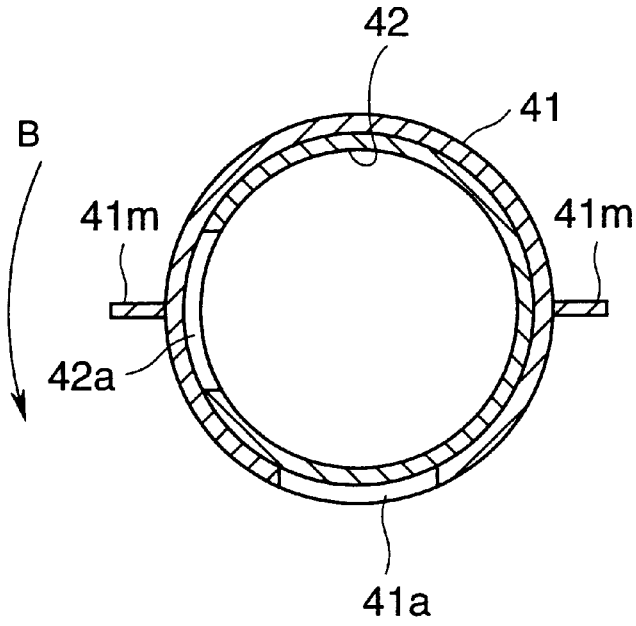
FIG. 6 is a transverse cross-sectional view taken along lines 6—6 of FIG. 5.

FIG. 6 is a transverse cross-sectional view taken along lines 6—6 of FIG. 5.

Referring to FIG. 5, an outer hollow cylindrical body 41 (referred to as "outer body" hereinafter) has a thin wall and a plurality of slit-like toner exiting openings 41*a* which are formed therein at predetermined locations and aligned along the length of the outer body 41. An inner hollow cylindrical body 42 (referred to as "inner body" hereinafter) has a thin wall and a plurality of slit-like toner exiting openings 42*a* which are formed therein at predetermined locations and aligned along the length of the inner body 42. The inner body 42 is slidably inserted into the outer body 41 and is rotatable relative to the outer body 41.

When the inner body 42 is rotated by operating a lever 42*f* in a direction away from the reader relative to the outer body 41 to the opening position (FIG. 9) with the toner exiting openings 41*a* facing down, the slit-like toner exiting openings 42*a* are brought into alignment with the toner exiting openings 41*a*, thereby cascading the toner from the toner cartridge 22 into the print process cartridge 14. When the inner body 42 is rotated by operating the lever 42*f* toward the reader relative to the outer body 41 to the closing position (FIG. 5, FIG. 6), where the openings 41*a* and 42*a* do not overlap each other, the toner exiting opening 41*a* is completely closed.

The inner body 42 is shorter than the outer body 41, so that the toner is in contact with the inner surface of the inner body 42 in region AR1 and the toner is directly in contact with the inner surface of the outer body 41 in region AR2. As shown in FIGS. 4 and 6, the outer body 41 has diametrically opposing two flanges 41*m* that outwardly radially project and axially extend along the length of the outer body 41. When the toner cartridge 22 has been loaded into the print process cartridge 14, the flanges 41*m* serve to prevent the outer body 41 from rotating as the inner body 42 is rotated relative to the outer body 41.

The inner body 42 is provided with the knob 42*e* at one longitudinal end thereof and a diametrically extending portion 42*b* (FIG. 10) at the other longitudinal end. The knob 42*e* and portion 42*b* are formed in one-piece construction with the inner body 42. The knob 42*e* closes one end of the inner body 42 and abuts one end of the outer body 41. A user operates the lever 42*f* of the knob 42*e* to rotate the inner body 42 relative to the outer body 41 when supplying toner.

Figure 7:
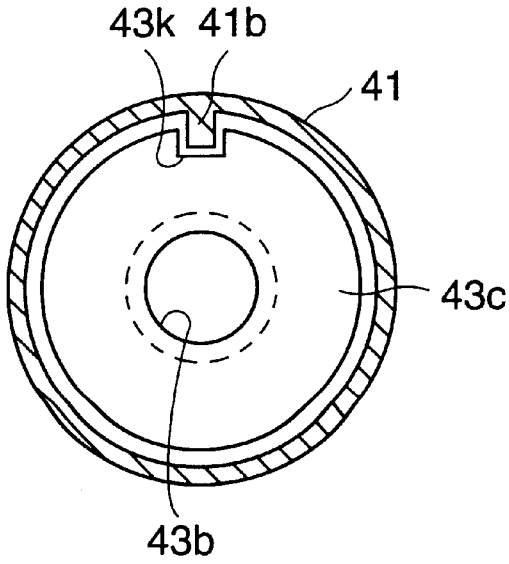
FIG. 7 is a transverse cross-sectional view taken along lines 7—7 of FIG. 5.

FIG. 7 is a transverse cross-sectional view taken along lines 7—7 in FIG. 5.

The partition 43 includes a cup 43*b*, a flange 43*c* that radially outwardly extends from the opening of the cup 43*b*, and a rod 43*a* that extends in an axial direction of the inner body 42 from the bottom of the cup 43*b* into the inner body 42. The rod 43*a* has a small projection 43*e* which radially outwardly projects from a portion adjacent to an end portion of the rod 43*a*. The flange 43*c* has a slightly smaller diameter than the inner diameter of the outer body 41 and is movable in a longitudinal direction of the outer body 41.

When the toner cartridge 22 is loaded into the print process cartridge 14, the cup 43*b* receives a toner outlet 92 (FIG. 20), which will be described later, formed in the frame 10 of the print process cartridge 14. The cup 43*b* receives the toner outlet 92 therein so that the toner outlet extends sufficiently deep into the area AR2, thereby preventing spillage of the residual toner from the toner cartridge.

Referring back to FIG. 7, in order to prevent the partition 43 from rotating relative to the outer body 41, a rib 41*b* projects from the inner surface of the outer body 41 which engages a recess 43*k* formed in the radially outer edge of the flange 43*c*.

One end of the outer body adjacent to region AR2 is closed by an annular plate 41*c* that is provided with a toner inlet 46 therein through which collected toner is introduced into region AR2. A sealing member 44 in the shape of an annular ring is sandwiched between the annular plate 41*c* and the flange 43*c*. The sealing member 44 is made of, for example, foamed urethane and seals the gaps between the outer body 41 and the flange 43*c* so that the toner in the toner cartridge 22 does not leak through the gaps.

Figure 8A:
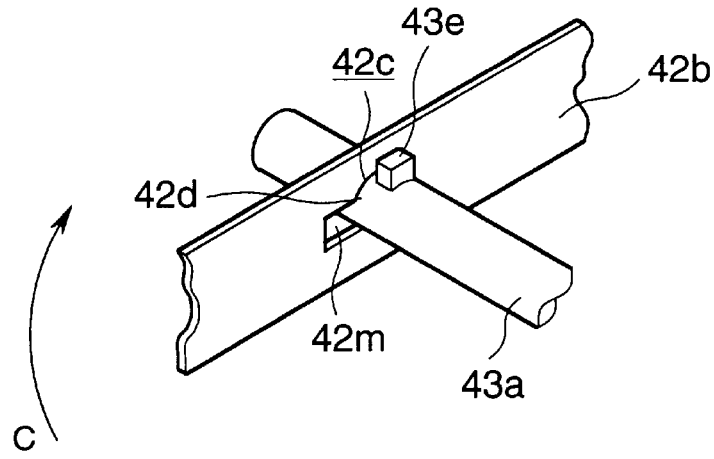
FIGS. 8A–8C illustrate the engagement relation between a portion 42*b* and rod 43*a* of FIG. 5.
Figure 8B:
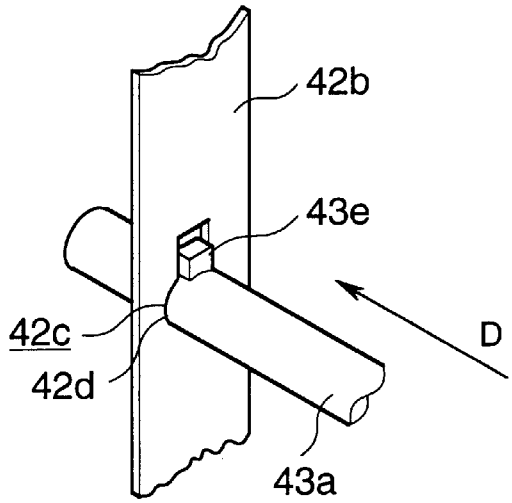
Figure 8C:
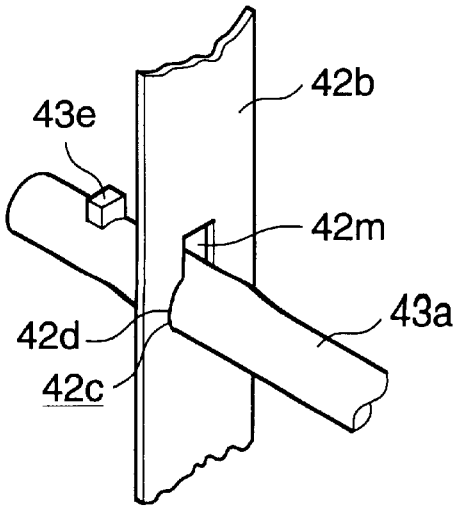

FIGS. 8A–8C illustrate the engagement relation between a portion 42*b* and rod 43*a*.

Figure 9:
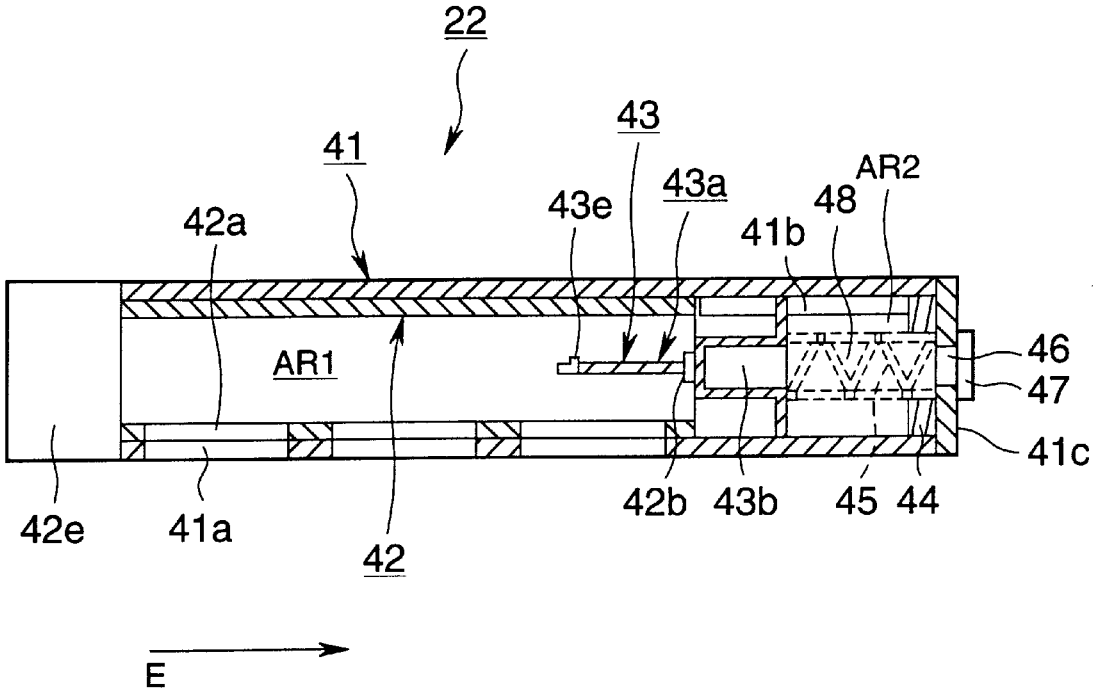
FIG. 9 is a longitudinal cross-sectional view of the toner cartridge of the first embodiment when it is loaded in the print process cartridge.

FIG. 9 is a longitudinal cross-sectional view of the toner cartridge when it is loaded in the print process cartridge.

A coil spring 45 is disposed between the annular plate 41*c* and the flange 43*c*. The projection 43*e* abuts the portion 42*b* as shown in FIG. 8A before the toner cartridge 22 is loaded in the print process cartridge so that the coil spring 45 is compressed as shown in FIG. 5. When the knob 42*e* is rotated to an angular position, the projection 43*e* is aligned with the cutout 42*m* as shown in FIG. 8B and subsequently freed from a locking relation with the portion 42*b* shown in FIG. 8C so that the projection 43*e* pops into region AR1 through the cutout 42*m* with the aid of the urging force of the coil spring 45. The projection 43*e* becomes aligned with the cutout 42*m* before the inner body 42 has been fully rotated to the opening position where openings 41*a* and 42*a* completely overlap each other. Alternatively, the projection 43*e* may be angularly oriented relative to the cutout 42*m* such that the projection 43*e* becomes aligned with the cutout 42*m* before the openings 41*a* and 42*a* begin to overlap each other as the inner body 42 is rotated relative to the outer body 41, provided that the projection 43*e* passes through the cutout 42*m* when the projection 43*e* is aligned with the cutout 42*m*.

The toner inlet 46 is kept closed by a shutter 47 before the toner cartridge 22 has been loaded into the print process cartridge 22. When the toner cartridge 22 has been loaded into the print process cartridge 22, the shutter 47 is opened and a shaft 91 with the toner outlet 92 (FIG. 20) extends through the toner inlet 46 into the region AR2 to enter the cup 43*b*. The toner outlet 92 extends through the coil spring 45 into the cup 43*b*.

Figure 10:
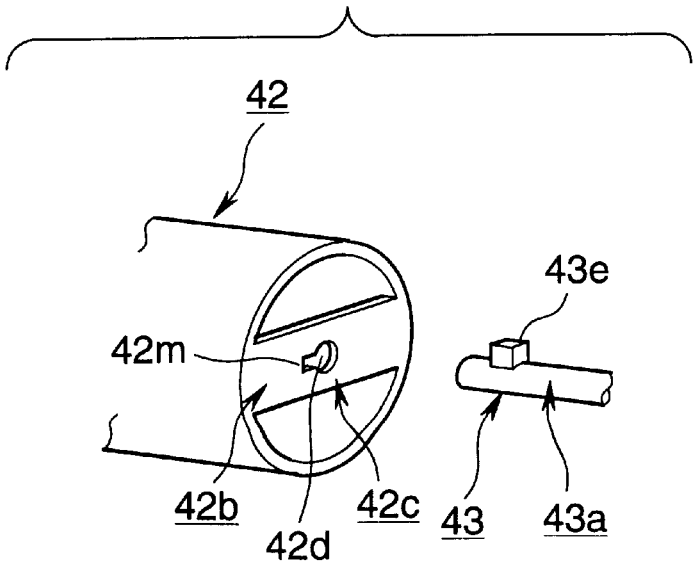
FIG. 10 is a fragmentary perspective view of a relevant portion of the toner cartridge of the first embodiment.

FIG. 10 is a fragmentary perspective view of a relevant portion of the toner cartridge.

The portion 42*b* is provided with a keyhole-like hole 42*c* in the middle thereof. The hole 42*d* has a circular portion 42*d* having a diameter slightly larger than that of the rod 43*a* and a rectangular cutout 42*m* extending in the direction in which the portion 42*b* extends.

When the inner body 42 is rotated to the angular position (FIG. 8B) where the projection 43*e* is aligned with the rectangular cutout 42*m*, the rod 43*a* and projection 43*e* pop into the inner body 42 through the hole 42*c*. In other words, the hole 42*c*, projection 43*e*, portion 42*b*, and coil spring 45 form a locking mechanism, which holds the partition 43 at a position (FIG. 5) close to the annular plate 41*c* when the inner body is at the closing position and allows the partition 43 to move to a position (FIG. 9) away from the annular plate 41*c* when the inner body is rotated to the angular position.

<Operation of Toner Cartridge>

The operation of the toner cartridge 22 will be described.

Immediately after the toner cartridge 22 has been loaded into the print process cartridge 14, the projection 43*e* of the rod 43 has not been aligned with the cutout 42*m* yet. Therefore, the rod 43 of the partition 43 is still in region AR2.

When the user operates the knob 42*e* to rotate the inner body 42 to the opening position, the cutout 42*m* is also brought into alignment with the projection 43*e*.

The urging force of the coil spring 45 causes the rod 43*a* and projection 43*e* to pop into region AR1 through the opening 42*c*. The cup 43*b* also moves together with the rod 43*a* toward region AR1 until the cup 43 abuts the portion 42*b*, pushing the remaining toner in the region AR2 into the region AR1. As the user further rotates the knob 42*e*, the toner exiting openings 41*a* are brought into complete alignment with the toner exiting openings 42*a* and the projection 43*e*. The toner residing in the region AR1 and the toner pushed from the region AR2 into the region AR1 begin falling into the process cartridge when the openings 42*a* begin overlapping the openings 41*a*. Most of the toner will have been discharged by the time the openings 41*a* and 42*a* completely overlap.

In this manner, a residual toner chamber 48 is defined in region AR2 after discharging the fresh toner into the print process cartridge 14 and the chamber 48 accommodates collected residual toner therein. When taking out the toner cartridge 22 from the print process cartridge 14, the user operates the knob 42*e* to rotate the inner body 42 in a direction opposite to arrow B in FIG. 4. Since the circular portion 42*d* of the keyhole-like hole 42*c* has a larger diameter than the rod 43*a*, the rod 43*a* does not interfere the rotation of the inner body 42 when the knob is operated to rotate the inner body 42 back to its closing position.

The residual toner chamber 48 is defined in region AR2 in which the fresh toner is accommodated. This construction provides a residual toner chamber in a toner cartridge while still allowing the toner cartridge 22 to hold substantially the same amount of toner therein without increasing the overall size of the toner cartridge 22.

This construction also lends itself to miniaturizing a toner cartridge and an electrophotographic printer.

Second Embodiment

A toner cartridge of a second embodiment is of the same construction as that of the first embodiment except the positions of the toner exiting openings 41*a* and 42*a* and cutout 42*m*. Therefore, the second embodiment will be described with reference to FIGS. 1–10.

Figure 11:
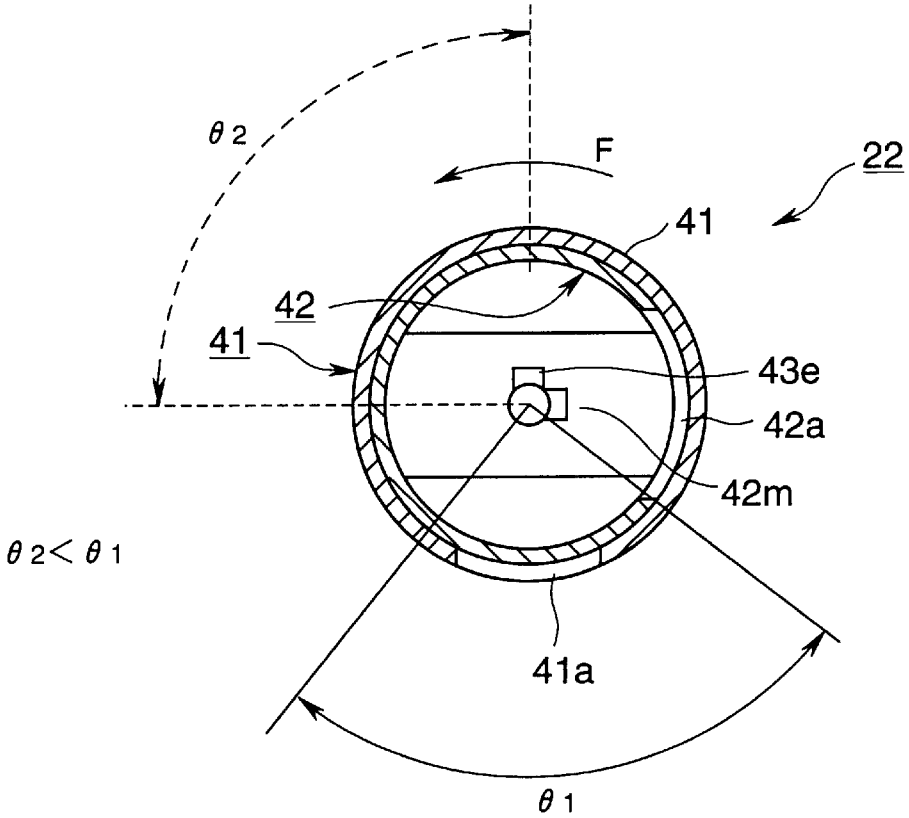
FIGS. 11 and 12 illustrate a toner cartridge according to a second embodiment.
Figure 12:
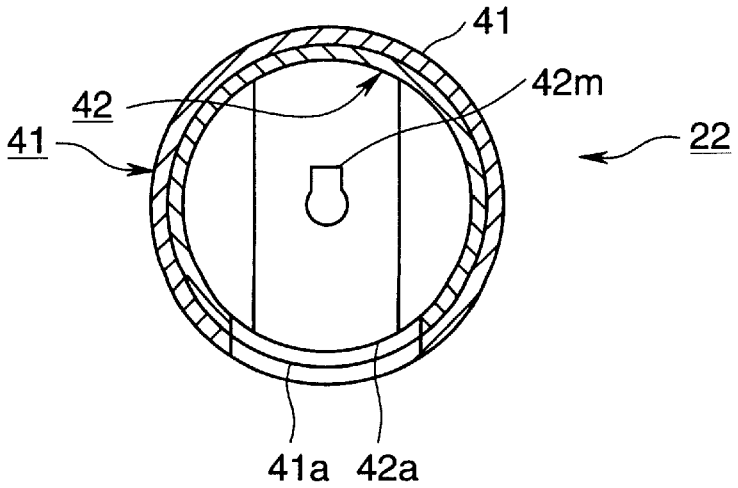

FIGS. 11 and 12 illustrate a toner cartridge according to the second embodiment.

Immediately after the toner cartridge 22 has been loaded in the print process cartridge 14, the toner exiting openings 41*a* and 42*a* are angularly displaced relative to each other by an angle θ 1 and the projection 43*e* and the cutout 42*m* are angularly displaced or rotated by an angle θ2. The partition 43 (FIG. 5) is in region AR2 (FIG. 5) before the toner cartridge is loaded into the print process cartridge 14.

In order to cascade the toner from the toner cartridge 22 into the print process cartridge 14, the inner body 42 is rotated until the toner exiting openings 41*a* are aligned with the toner exiting openings 42*a*. And, when the inner body 42 has been rotated by the angle θ, the projection 43*e* is also aligned with the cutout 42*m*.

As a result, the urging force of the coil spring 45 causes the rod 43*a* and projection 43*e* enters region AR1 through the opening 42*c* (FIGS. 8B–8C). The cup 43*b* of the partition 43 also moves toward region AR1 until it abuts the portion 42*b*, pushing the toner in the region AR2 to the toner exiting openings 41*a* and 42*a* so that the toner cascades through the toner exiting openings 41*a* and 42*a* into the print process cartridge 14.

In this manner, a residual toner chamber 48 (FIG. 9) is defined. The residual toner chamber 48 accommodates collected residual toner which is delivered through the toner outlet 92. When taking out the toner cartridge 22 from the print process cartridge 14, the user operates the knob 42*e* to rotate the inner body 42 back to the closing position (FIGS. 5–6). Since the circular portion 42*d* has a larger diameter than the rod 43*a*, the rod 43*a* does not interfere with the rotation of the inner body 42.

In the second embodiment, the angle θ 1 is selected slightly larger than the angle θ 2. Thus, the projection 43*e* is prevented from being aligned with the cutout 42*m* until just before the inner body 42 has been rotated through the angle θ 1.

The effective opening areas defined by the toner exiting openings 41*a* and 42*a* gradually increases as the inner body 42 is rotated, increasing the amount of toner being cascaded into the print process cartridge 14. Most of the toner in the toner cartridge 22 will have cascaded into the print process cartridge 14 by the time the inner body 42 has completely rotated through angle θ1.

Little or no toner will have been left in the region AR1 by the time that the partition 43 moves toward region AR1. Since the partition 43 is restricted to move until just before the inner body 42 completes its rotation, there is no possibility of the partition 43 compressing the toner in the toner cartridge 22. Thus, the toner in good condition is supplied to the print process cartridge 14.

Third Embodiment

When mass-producing the toner cartridge 22, the toner cartridge 22 is filled with toner automatically using a toner filling apparatus. The toner particles are mixed with air so that the toner acquires fluidity. Thus, the apparent volume of toner will be large and therefore the toner cartridge may not be filled with a sufficient amount of toner.

A third embodiment is directed to a toner cartridge that can be filled with a sufficient amount of toner.

Figure 13:
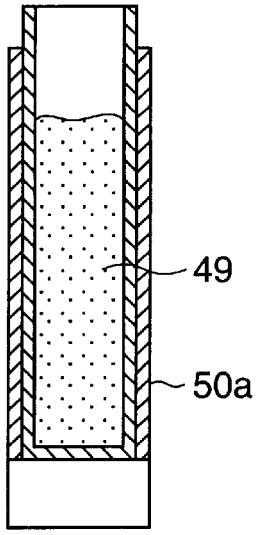
FIG. 13 illustrates a toner cartridge according to a third embodiment when it is filled with toner.
Figure 14:
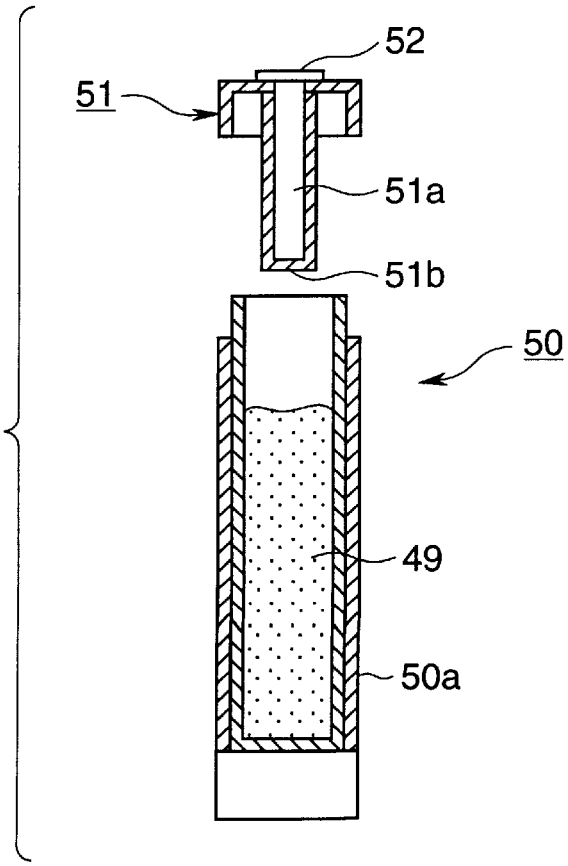
FIGS. 14–16 illustrate various stages when the toner cartridge is assembled.
Figure 15:
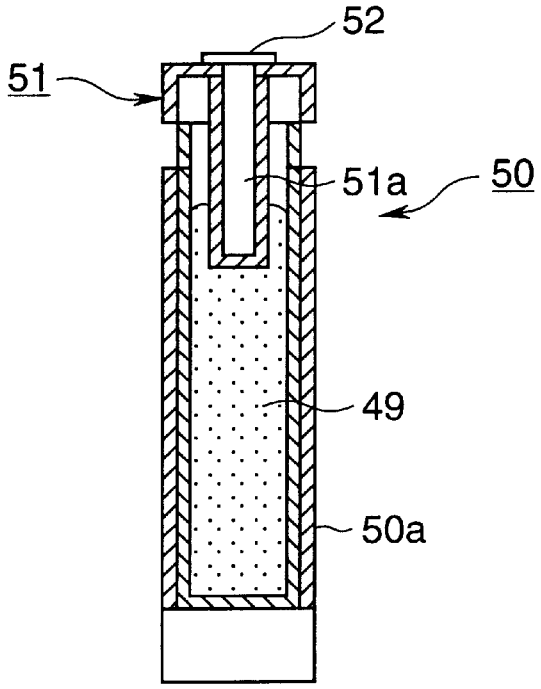
Figure 16:
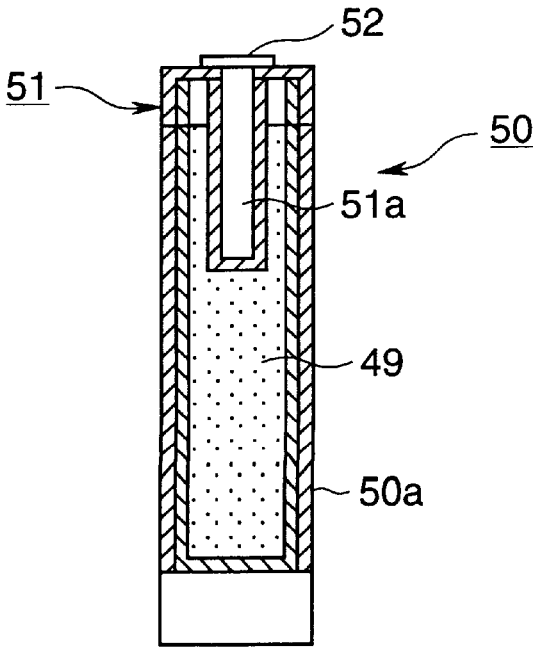

FIG. 13 illustrates a toner cartridge according to the third embodiment when it is being filled with toner. FIGS. 14–16 illustrate various stages when the toner cartridge 50 is assembled.

Referring to FIG. 13, toner 49 is introduced into a main body 50*a* of a toner cartridge 50 with the main body 50*a* subjected to vibration, thereby letting air out of the toner. Thus, there will be a space at the upper end of the toner cartridge 50, the space being equal to a volume of air drawn. Use can be made of this space to form a chamber that accommodates residual toner.

Then, as shown in FIGS. 14–16, a lid 51 is lowered to the main body 50*a* from above to sealingly close the upper end of the toner cartridge 50. The lid 51 has walls that define a toner chamber 51*a* that accommodates the collected residual toner therein. Just as in the first embodiment, a shutter 52 is opened when the toner cartridge 50 has been loaded into the print process cartridge 14.

The procedure of assembling the toner cartridge 50 of the aforementioned construction will be described.

Referring to FIG. 14, the upper surface of the toner 49 is a little below the upper end of the main body 50*a* and the density of toner increases with increasing depth of the toner due to the gravity acting on the toner. As shown in FIG. 15, when the lid 51 closes the main body 50*a*, the lid 51 pushes the toner out of the way, the toner being pushed up into the upper space and the air trapped in the toner 49 being released. Then, as shown in FIG. 16, the lid 51 completely closes the upper end of the main body 50*a* for sealing.

Upon completion of the assembly, the toner cartridge 50 holds the toner 49 therein with some space which prevents the toner 49 from clumping.

The bottom wall 51*b* of the residual toner chamber 51*a* of the third embodiment is shaped to be flat. The bottom 51*b* may also be, for example, tapered. A tapered bottom is advantageous in that when the lid 51 is lowered, the reaction of the toner 49 acting on the bottom of the toner chamber 51*a* is small and therefore the assembly efficiency of the toner cartridge 50 is increased.

In this manner, the toner chamber 51 that accommodates collected toner is formed in a space, created in the main body 50*a* when the main body 50*a* is filled with toner 49. Thus, the residual toner chamber 51*a* can be provided in the toner cartridge 50 while still holding the same amount of toner 49 in the main body 50*a*. This construction lends itself to miniaturizing the electrophotographic recording apparatus. A larger space for the residual toner chamber can be created if the main body 50*a* with the toner 49 filled therein is subjected to vibration.

Fourth Embodiment

A fourth embodiment is directed to a toner cartridge where an agitating member is rotated within the toner cartridge to facilitate the cascading of the toner into the print process cartridge 14.

<Construction>

Figure 17A:
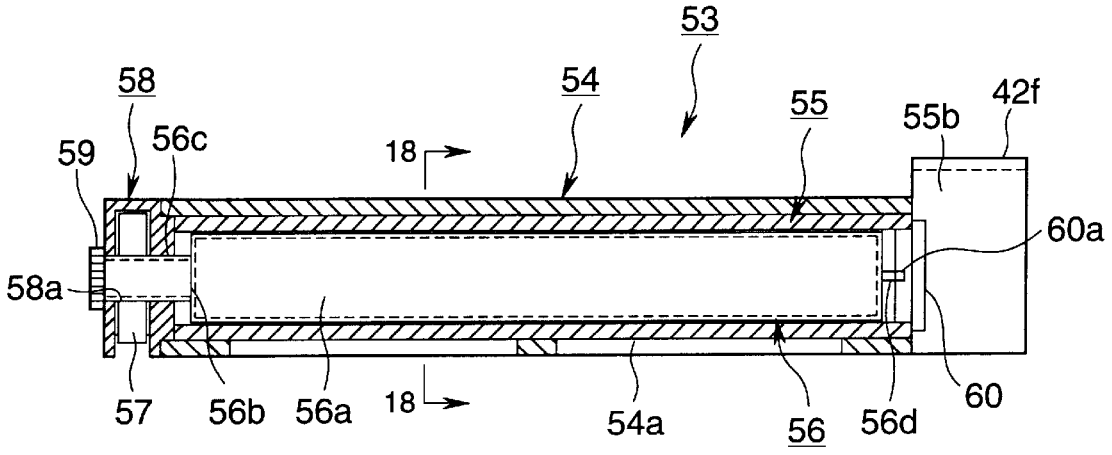
FIG. 17A is a longitudinal cross-sectional view of the toner cartridge according to a fourth embodiment.

FIG. 17A is a cross-sectional view of the toner cartridge according to the fourth embodiment.

Figure 17B:
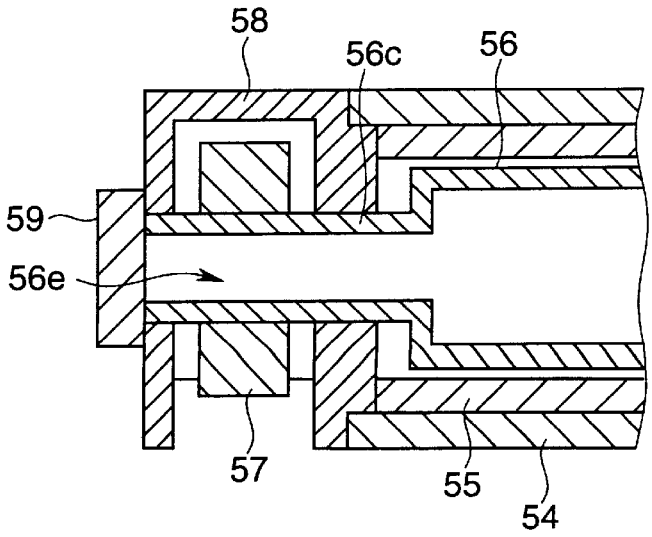
FIG. 17B is a fragmentary enlarged view of FIG. 17A.

FIG. 17B is a fragmentary enlarged view of FIG. 17.

Figure 17C:
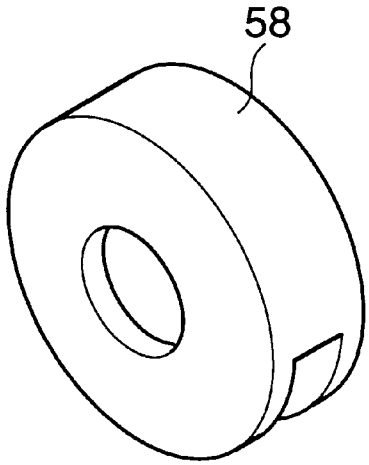
FIG. 17C is a perspective view of a side plate 58.

FIG. 17C is a perspective view of a side plate 58

Figure 18:
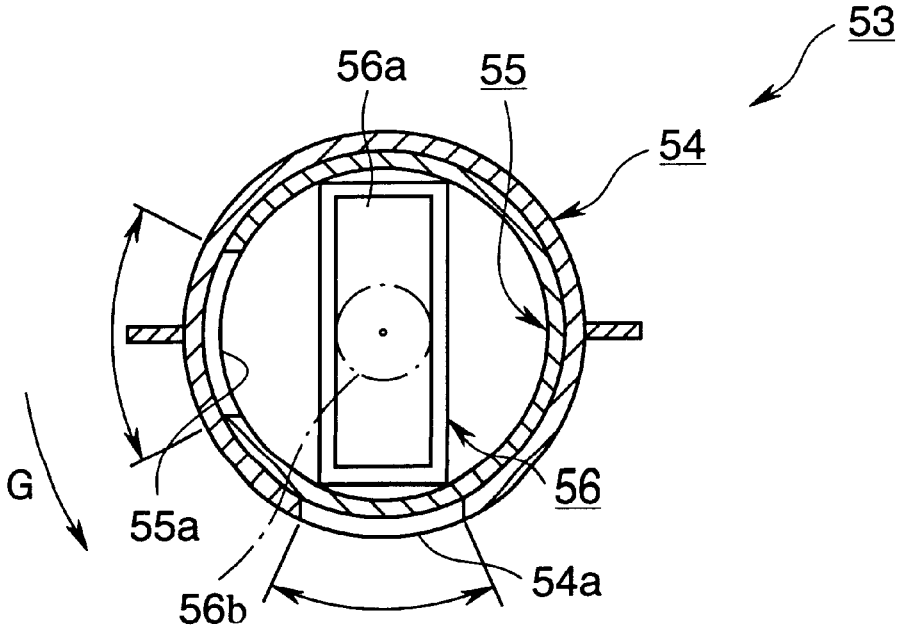
FIG. 18 is a cross-sectional view taken along lines 18—18 of FIG. 17A.

FIG. 18 is a cross-sectional view taken along lines 18—18 of FIG. 17A.

Referring to FIG. 17A–17C and 18, an outer body 54 has a thin wall and a plurality of slit-like toner exiting openings 54*a* which are formed therein at predetermined locations and aligned along the length of the outer body. An inner body 55 has a thin wall and a plurality of slit-like toner exiting openings 55*a* which are formed therein at predetermined locations and aligned along the length of the inner body 55. The inner body 55 is slidably inserted into the outer body 54 and is rotatable relative to the outer body 54. When the inner body 55 is rotated in a direction shown by arrow G in FIG. 18, and relative to the outer body 54 with the toner exiting openings 54*a* facing down, the slit-like toner exiting openings 55*a* come into alignment with the toner exiting openings 54*a*, thereby cascading the toner from the toner cartridge 53 into the print process cartridge 14 (FIGS. 2 and 3). When the inner body 55 is rotated relative to the outer body 54 until the openings 54*a* and 55*a* do not overlap each other, the toner exiting openings 54*a* are completely closed.

The inner body 55 has a knob 55*b* on one end thereof and the side plate 58 shown in FIG. 17C on the other end. The knob 55*b* is formed in one piece construction with the inner body 55 and closes the one longitudinal end of the inner body while the side plate 58 closes the other longitudinal end of the inner body 55. The knob 55*b* also abuts one end of the outer body 54. The side plate 58 has a gear 57 built therein. A user operates the knob 55 to rotate the inner body 55 relative to the outer body 54 just as in the other embodiments.

An agitating member 56 having a rectangular cross-section is rotatably supported in the inner body 55. The agitating member 56 has a residual toner chamber 56*a* therein that accommodates collected toner therein. The outer corners of the agitating member 56 are very close to the inner circumferential surface of the inner body 55, so that when the agitating member 56 is rotated, the toner in the cartridge is sufficiently agitated.

Figure 19:
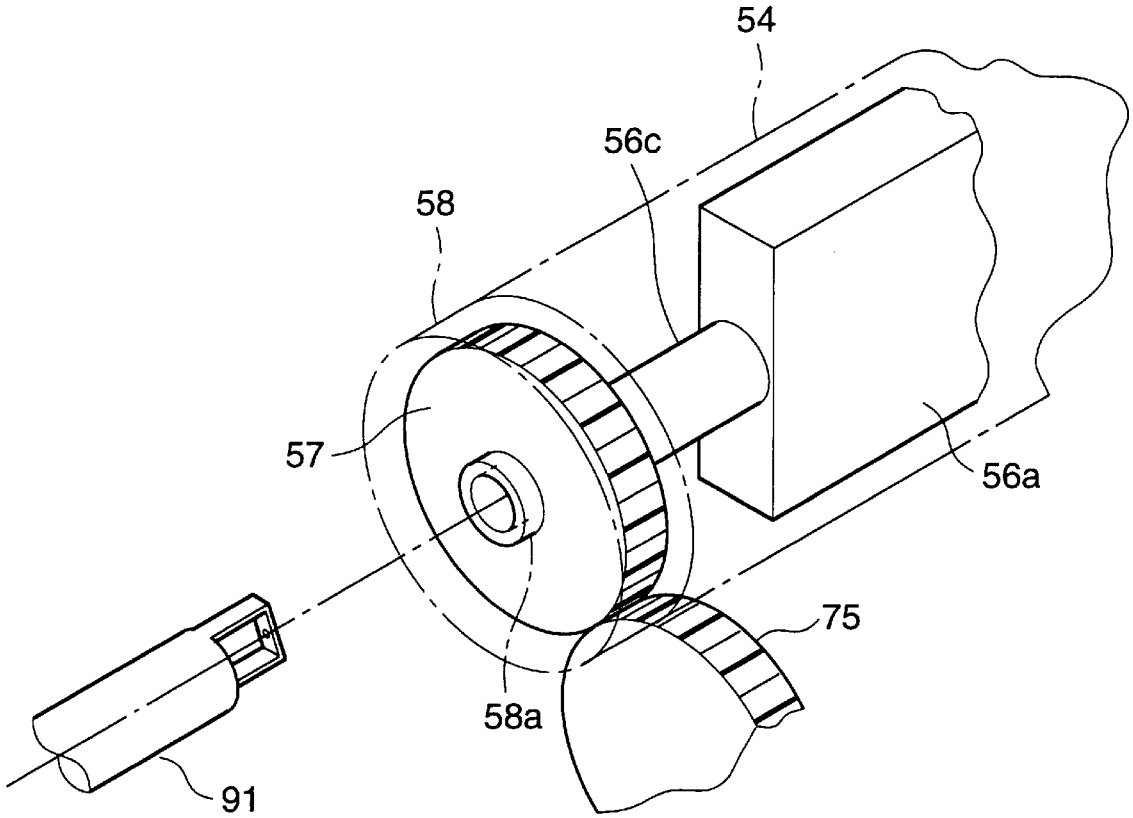
FIG. 19 illustrates the relevant portion of the toner cartridge of the fourth embodiment.

FIG. 19 illustrates the relevant portion of the toner cartridge 53. The gear 57 is coupled to the agitating member 56 via, for example, a "D-cut" part of a shaft 56*c* of the agitating member 56, so that when the gear 57 is driven in rotation, the agitating member 56 also rotates together with the gear 57. The shaft 56*c* is a cylinder having a hollow 56*e* that communicates with the residual toner chamber 56*a*. The side plate 58 is provided with a hole 58*a* in its middle and rotatably supports the shaft 56*c* of the agitating member 56 that extends through the hole 58*a*. When the toner cartridge has been loaded into the print process cartridge 14, the toner outlet 92 enters the hollow 56*e* of the shaft 56*c*.

A shutter 59 is provided which closes the shaft 56*c* when the toner cartridge 53 is taken out of the print process cartridge 14, thereby preventing the collected residual toner from leaking from the residual toner chamber 56*a*. The shutter is biased by a biasing means, not shown, to a closing position. When the toner cartridge 53 is loaded into the print process cartridge 14, the shutter 59 is pushed up to an opening position against the biasing force by a projection, not shown, provided on the print process cartridge 14, so that the collected residual toner is directed into the residual toner chamber 56*a* through the inlet 56*b*. When the toner cartridge 53 is unloaded from the print process cartridge 14, the shutter 59 is moved to the closing position by the biasing means.

A lid 60 closes the one end of the inner body 55 after the inner body 55 has been filled with toner. The lid 60 is provided with a recess 60*a* in its center, the recess 60*a* rotatably supporting the shaft 56*d* of the agitating member 56. Alternatively, the recess 60*a* and shaft 56*d* may be reversed with respect to the lid 60 and agitating member 56. That is, a recess may be formed in the agitating member 56 and a projection, not shown, may be formed in the lid 60.

<Coupling Between Toner Cartridge and Print Process Cartridge>

A structure for coupling the toner cartridge 53 to the print process cartridge 14 will be described. The toner cartridge 53 is loaded into the print process cartridge 14 via the coupling structure.

Figure 20:
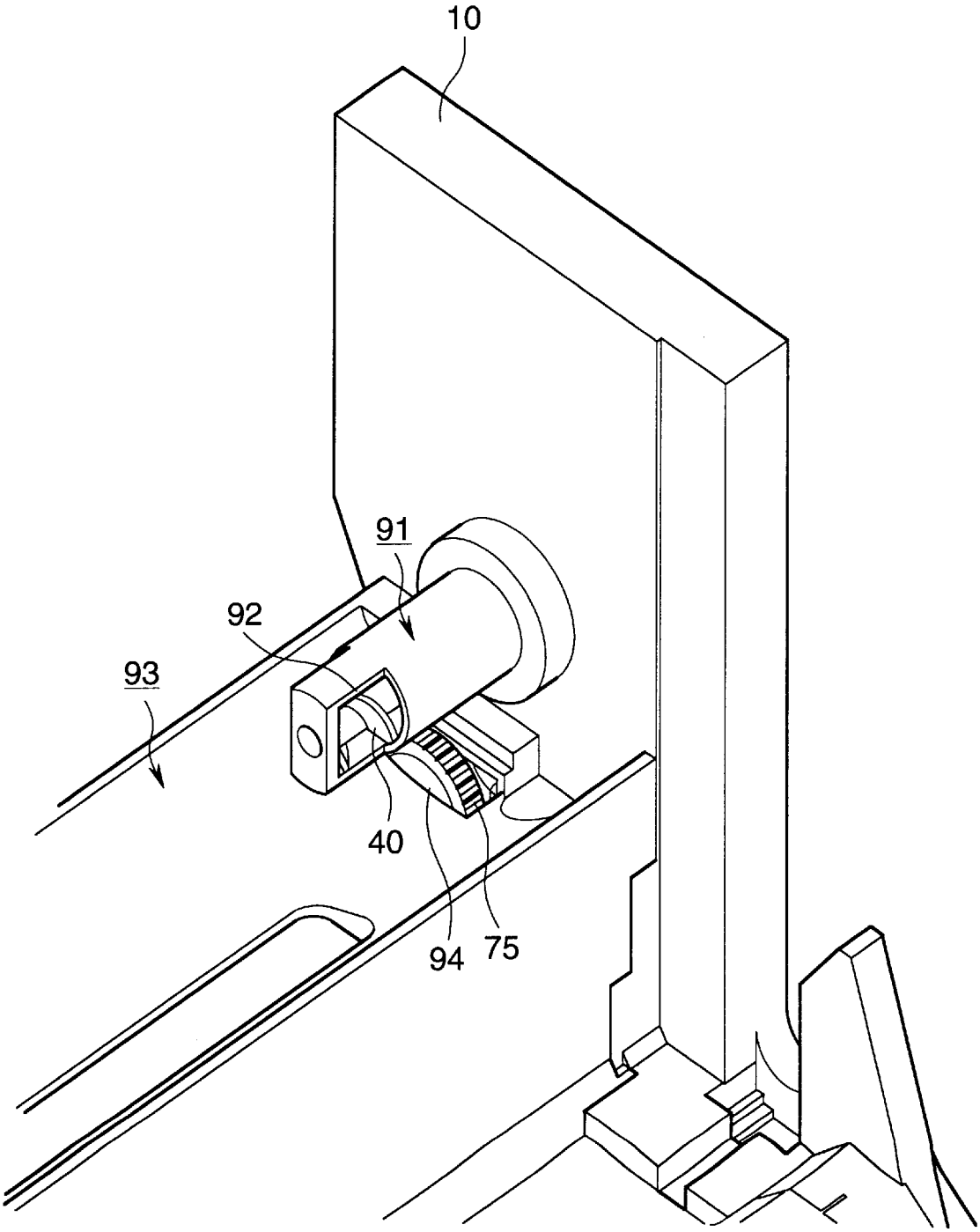
FIG. 20 is a perspective view of the print process cartridge 14 according to the fourth embodiment.

FIG. 20 is a perspective view of the print process cartridge 14 according to the fourth embodiment.

Referring to FIG. 20, a recess 93 receives the toner cartridge 53. The recess 93 is provided with an opening 94 under the cylinder 91. A part of a gear 75 extends upwardly through the opening 94 and rotates in mesh with the gear 57 of the toner cartridge 53. A hollow cylinder 91 extends through a side frame 10 of the print process cartridge 14 (FIG. 3) and a screw conveyor 40 is rotatably inserted into the cylinder 91. Once the toner cartridge 53 has been loaded into the print process cartridge 14, the gear 57 becomes in mesh with the drive gear 75 (FIG. 20) and the toner outlet 92 enters the hollow 56*e* of the shaft 56*c*. The screw conveyor 40 delivers the collected toner from the residual toner tank 71 into the toner cartridge 53 (FIG. 17A) through the toner outlet 92 formed in the cylinder 91.

<Operation of the Toner Cartridge>

The operation of the toner cartridge 53 will now be described.

Figure 21:
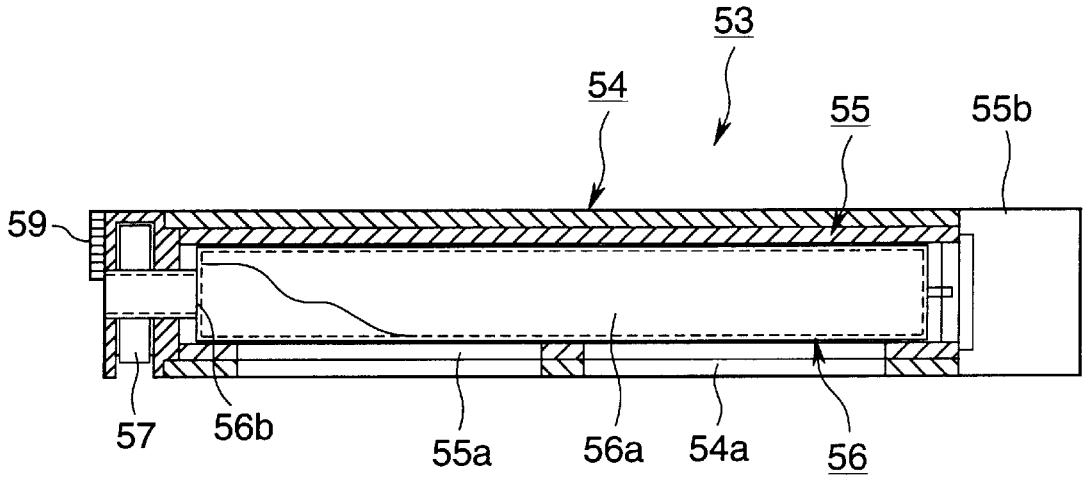
FIGS. 21 and 22 illustrate the operation of the toner cartridge 53 according to the fourth embodiment.
Figure 22:
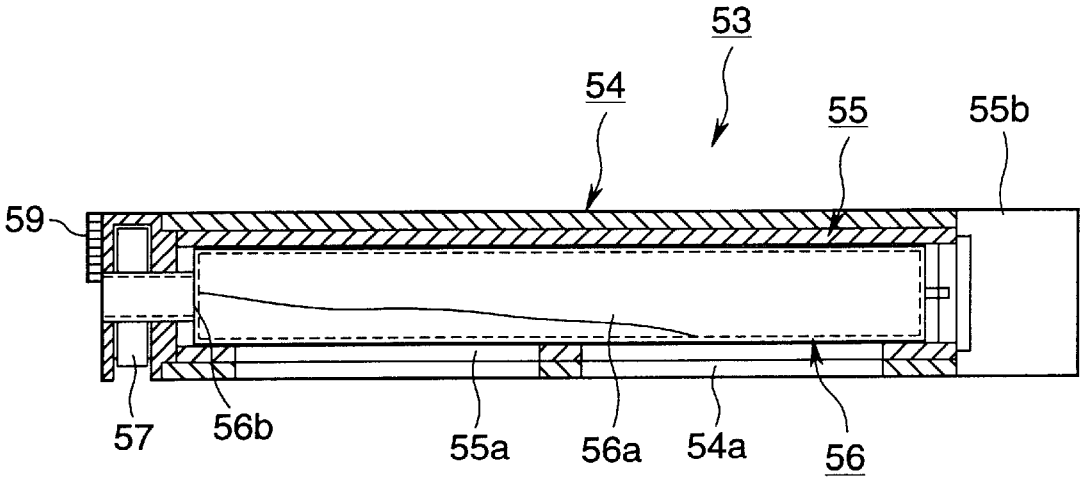

FIGS. 21 and 22 illustrate the operation of the toner cartridge 53 according to the fourth embodiment. FIGS. 21 and 22 assume that the toner cartridge 53 has been loaded into the print process cartridge 14.

When the knob 55*b* is rotated through a predetermined angle so that the toner exiting openings 54*a* and 55*a* are aligned with each other, the toner in the toner cartridge 53 is supplied into the print process cartridge 14.

When the electrophotographic recording apparatus enters its print operation, the rotation transmitted to the drive gear 75 is transmitted through the gear 57 to the agitating member 56. At this time, the outer body 54 tends to rotate together with the gear 57. The ribs, not shown, formed on the outer surface of the outer body 54 (similar to 41*m* in FIG. 4) engage the upper edges of the recess 93 to prevent the rotation of the outer body 54.

The agitating member 56 is driven in rotation by the gear 57 and the remaining toner in the toner cartridge 53 is introduced into the print process cartridge 14.

The collected toner is directed through the inlet 56*b* into the residual toner chamber 56*a*. As shown in FIGS. 21–22, the collected toner introduced into the residual toner chamber 56*a* is leveled off as the agitating member continues to rotate, the toner moving further into the residual toner chamber 56*a*.

In the fourth embodiment, the residual toner chamber 56*a* is formed in the agitating member 56 and there is no need for making the length of the toner cartridge 53 longer to provide a residual toner chamber. Thus, the construction allows miniaturizing the electrophotographic recording apparatus.

Fifth Embodiment

Elements similar to those of the fourth embodiment have been given the same reference numerals and the description thereof is omitted.

Figure 23:
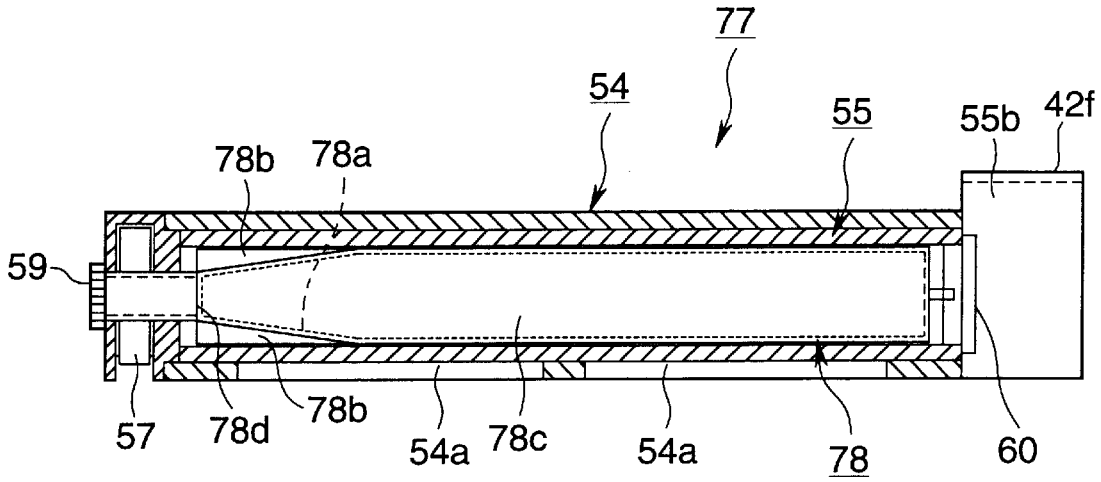
FIG. 23 is a cross-sectional view of a toner cartridge 77 according to a fifth embodiment.

FIG. 23 is a cross-sectional view of a toner cartridge 77 according to a fifth embodiment.

Referring to FIG. 23, the agitating member 78 extends in a toner cartridge 77. The agitating member 78 has a residual toner chamber 78*c* formed therein. The residual toner chamber 78*c* has inclined inner surfaces 78*a* that taper toward the inlet 78*d* near the gear 57. The agitating member 78 has flaps 78*b* that outwardly extend from the outer surface of the tapered portion. The flaps 78*b* are disposed symmetric with respect to the rotational axis of the residual toner chamber 78*c*. The flaps 78*b* serve to still maintain the same agitating effect despite the fact that the agitating member 78 tapers toward the inlet 78*d*.

In the fifth embodiment, the collected toner is introduced into the residual toner chamber 78*c* through the inlet 78*d*, being moved along the inclined inner surface 78*a*. Thus, the toner is not trapped near the inlet 78*d* but smoothly moved into the residual toner chamber 78*c*.

Sixth Embodiment

Figure 24:
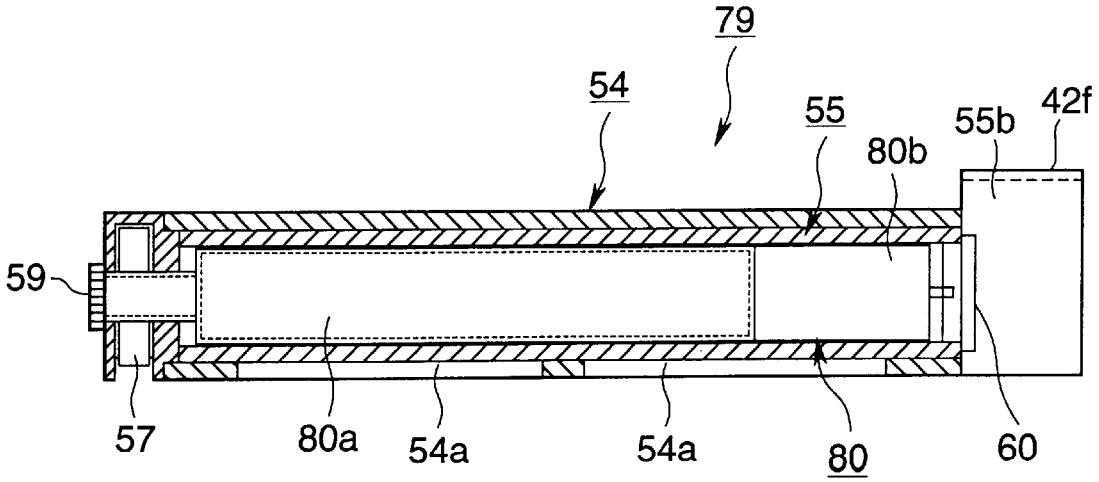
FIG. 24 is a cross-sectional view of a toner cartridge 79 according to a sixth embodiment.

FIG. 24 is a cross-sectional view of a toner cartridge 79 according to a sixth embodiment.

Figure 25:
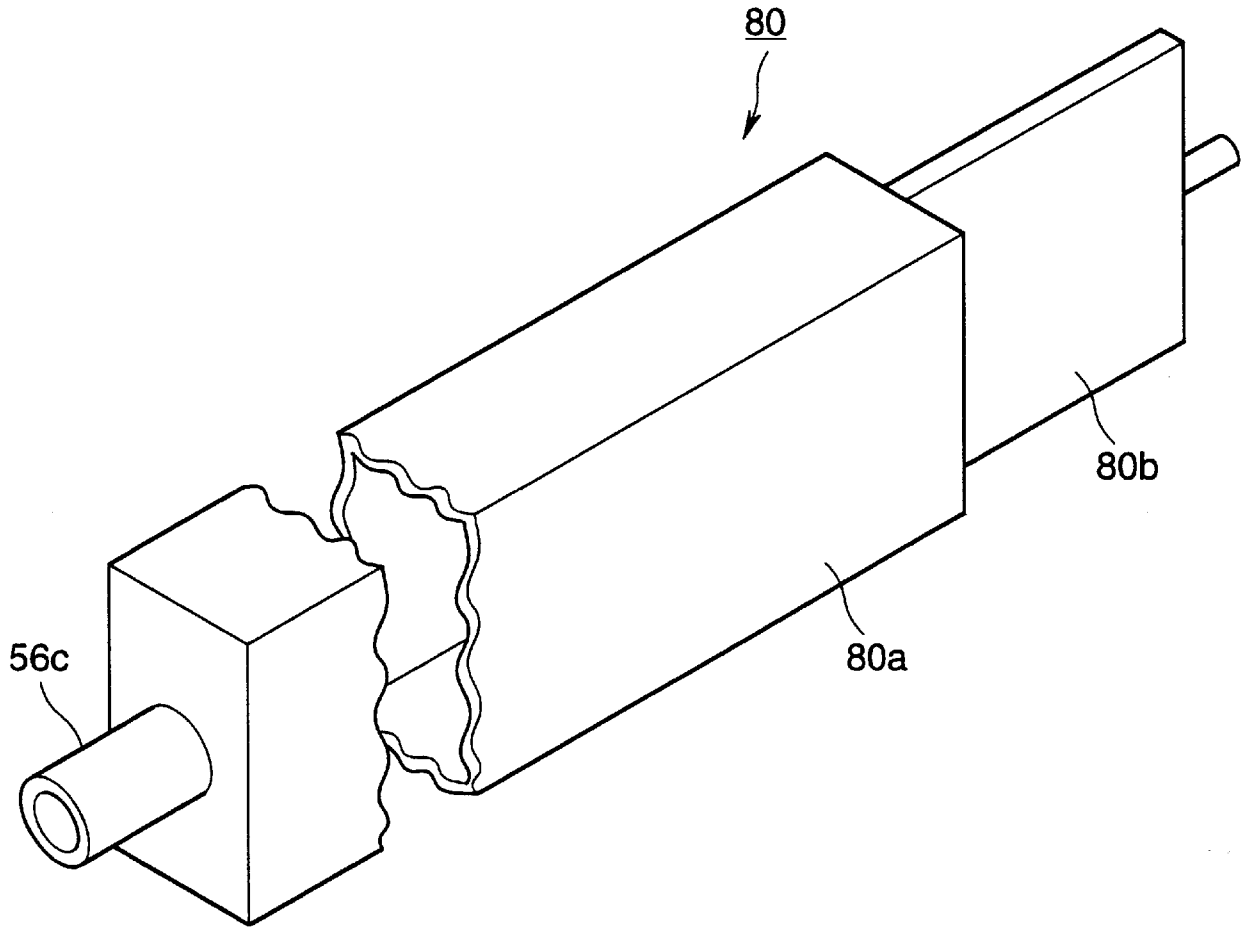
FIG. 25 is a perspective view of an agitating member 80 of the sixth embodiment.

FIG. 25 is a perspective view of an agitating member 80.

Elements of the same construction as those of the fourth embodiment have been given the same reference numerals and the description thereof is omitted.

Referring to FIG. 24, after the inner body 55 of the toner cartridge 79 has been filled with toner, a lid 60 closes one end of the inner body 55. The agitating member 80 has a residual toner chamber 80*a* therein. The residual toner chamber 80*a* does not extend as far as the lid 60. The agitating member 80 has a flap 80*b* that extends between the residual toner chamber 80*a* and the lid 60. The flap 80*b* serves to still maintain the same agitating effect as the fourth embodiment despite the fact that residual toner chamber 80*a* does not extend fully in the toner cartridge 77.

This construction is advantageous in that when the inner body 55 is being filled with toner, the agitating member 80 does not interfere with the toner being introduced.

Seventh Embodiment

Figure 26:
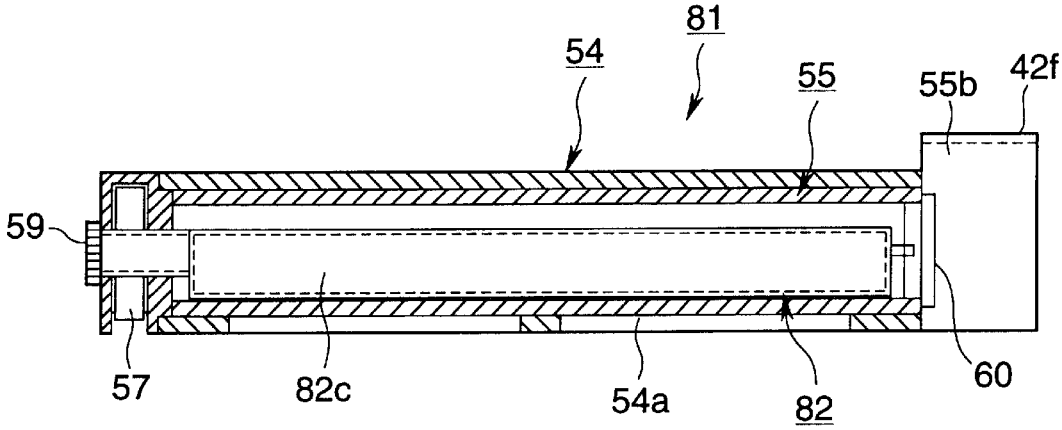
FIG. 26 is a cross-sectional view of a toner cartridge 81 according to a seventh embodiment.

FIG. 26 is a cross-sectional view of a toner cartridge 81 according to a seventh embodiment. Elements of the same construction as those of the fourth embodiment have been given the same reference numerals and the description thereof is omitted.

Referring to FIG. 26, the toner cartridge 81 includes an agitating member 82. The agitating member 82 has a residual toner chamber 82*c* therein. The agitating member 82 is asymmetric with respect to its rotational axis and extends substantially between the rotational axis and one of diametrically opposed circumferential inner surfaces of the inner body 55. This construction reduces the volume of the residual toner chamber 82*c*, thereby ensuring that the inner body 55 holds some more toner. This construction is useful if the amount of collected toner is relatively small.

Eighth Embodiment

Figure 27:
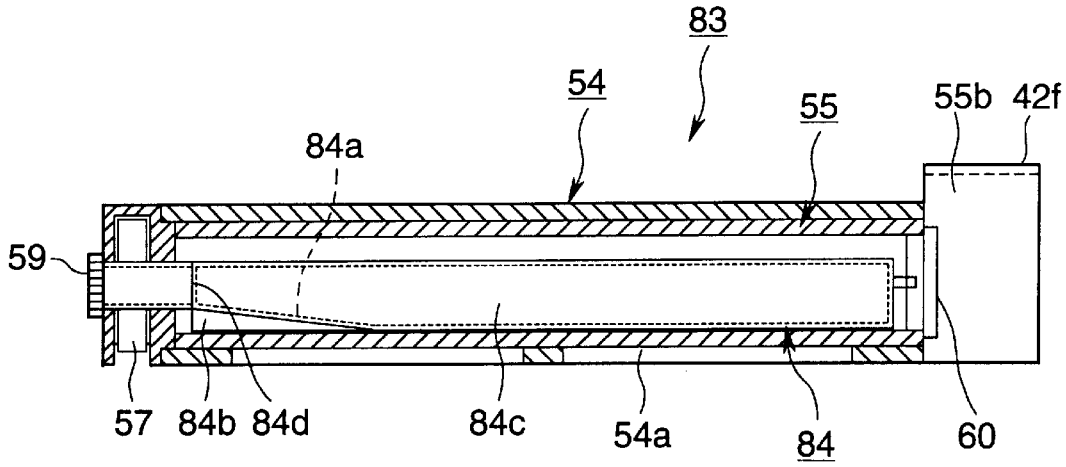
FIG. 27 is a cross-sectional view of a toner cartridge 83 according to an eighth embodiment.

FIG. 27 is a cross-sectional view of a toner cartridge 83 according to an eighth embodiment. Elements of the same construction as those of the fifth embodiment have been given the same reference numerals and the description thereof is omitted.

Referring to FIG. 27, the toner cartridge 83 includes an agitating member 84. The agitating member 84 has a residual toner chamber 84*c*. The residual toner chamber 84*c* has an inclined inner surface 84*a* so that the inclined surface 84*a* and an inner surface opposing the inclined surface 84*a* form a structure that tapers toward the inlet 84*d*. The agitating member 84 is asymmetric with respect to its rotational axis and has the residual toner chamber 84*c* that extends substantially between the rotational axis of the agitating member 84 and one of diametrically opposed circumferential inner surfaces of the inner body 55. This construction reduces the volume of the residual toner chamber 84*c*, thereby ensuring that the inner body 55 holds some more toner. This construction is useful if the amount of collected toner is relatively small.

The inclined inner surface 84*a* facilitates the movement of collected toner into the residual toner chamber 84*c* through the inlet 84*d*. Thus, the toner is not trapped near the inlet 78*d* but smoothly moved into the residual toner chamber 84*c*.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge, comprising:

a hollow outer body, extending in a longitudinal direction thereof and having a longitudinal end, said outer body having at least one first opening formed therein;

a hollow inner body inserted into said outer body and slidable relative to said outer body, said inner body holding toner therein, said inner body having at least one second opening formed therein, the second opening being aligned with the first opening when said inner body is slid relative to said outer body, thereby allowing the toner to be discharged out of the inner body;

a partition disposed in said outer body, said partition being slidable relative to said outer body in the longitudinal direction, said partition moving from a first position to a second position when said inner body is slid relative to said outer body, thereby defining a residual toner accommodating space between said partition and the longitudinal end.

2. The toner cartridge according to claim 1, wherein when said partition is at said first position, the toner is held adjacent the partition.

3. The toner cartridge according to claim 2 further including a locking mechanism, wherein said locking mechanism holds said partition at the first position when said inner body is at a closing position where the toner does not come out of the toner cartridge, and allows said partition to move to the second position when said inner body is slid to an opening position where the toner is discharged.

4. The toner cartridge according to claim 2, wherein said partition reaches the second position just before the said inner body has been slid to the opening position.

5. A toner cartridge, comprising:

a main body, holding fresh toner therein, said main body having a first opening; and a lid, closing the first opening of said main body, said lid having walls that completely define a residual toner chamber, so that the residual toner chamber is formed only in the lid and is completely separated from the main body by the walls, said lid having a second opening through which the residual toner chamber receives residual toner from outside, wherein when said lid is assembled to said main body to close the first opening, the walls are received in said main body so that the residual toner chamber extends into said main body.

6. The toner cartridge according to claim 5, wherein said main body is a hollow body extending in a longitudinal direction thereof, and the first opening is at one longitudinal end thereof; and wherein the residual toner chamber extends substantially parallel to the longitudinal direction and the second opening is substantially aligned with the first opening.

7. A toner cartridge, comprising:

a hollow outer body extending in a longitudinal direction thereof, said outer body having at least one first opening formed therein;

a hollow inner body slidably inserted into said outer body, said inner body holding toner therein, said inner body being slidable relative to said outer body and having at least one second opening corresponding to said first opening; and an agitating member supported in said inner body, said agitating member being rotatable relative to said inner body and said outer body substantially about a longitudinal axis of said inner body, said agitating member having a residual toner accommodating space therein.

8. The toner cartridge according to claim 7, wherein said agitating member is rotated about the longitudinal axis, said agitating member radially projecting and axially extending substantially between the longitudinal axis and an inner surface of the inner body.

9. The toner cartridge according to claim 7, wherein said agitating member is rotated about the longitudinal axis, said agitating member being substantially symmetric with respect to the longitudinal axis.

10. The toner cartridge according to claim 9, wherein said residual toner accommodating space tapers toward one end of the longitudinal axis.

11. The toner cartridge according to claim 9, wherein said agitating member has a flap that rotates together with said agitating member about the longitudinal axis.

12. The toner cartridge according to claim 7, wherein said agitating member is substantially asymmetrical with respect to the longitudinal axis.

13. The toner cartridge according to claim 12, wherein said residual toner accommodating space tapers toward one end of the longitudinal axis.

* * * * *